US007490824B2

(12) United States Patent
Kakuta

(10) Patent No.: US 7,490,824 B2
(45) Date of Patent: Feb. 17, 2009

(54) IMAGE FORMING APPARATUS

(75) Inventor: Masayuki Kakuta, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 328 days.

(21) Appl. No.: 11/528,098

(22) Filed: Sep. 27, 2006

(65) Prior Publication Data

US 2007/0069445 A1 Mar. 29, 2007

(30) Foreign Application Priority Data

Sep. 28, 2005 (JP) ..... 2005-282576
Aug. 10, 2006 (JP) ..... 2006-218517

(51) Int. Cl.
*B65H 5/22* (2006.01)

(52) U.S. Cl. ..... 271/3.01; 271/3.14; 271/264; 399/379; 399/380; 358/496

(58) Field of Classification Search ..... 271/3.01, 271/3.14, 4.01, 264; 399/367, 379, 380; 358/496, 498
See application file for complete search history.

(56) References Cited

U.S. PATENT DOCUMENTS 5,338,018 A * 8/1994 Nagao et al. ..... 271/3.05
7,149,005 B2 * 12/2006 Chung ..... 358/474
7,392,009 B2 * 6/2008 Iwago ..... 399/367
2005/0163546 A1 * 7/2005 Kim ..... 399/367
2006/0013627 A1 * 1/2006 Choi ..... 399/367

FOREIGN PATENT DOCUMENTS

JP 2001235909 8/2001
JP 2002189319 7/2002

* cited by examiner

*Primary Examiner*—David H Bollinger
(74) *Attorney, Agent, or Firm*—The Webb Law Firm

(57) ABSTRACT

An image forming apparatus includes a platen glass face provided in an apparatus body and having a reading area for reading a document set under a stationary condition thereof and an automatic reading area for reading the document while the document is guided past over this automatic reading area by an automatic document feeding mechanism, a cover means mounting said automatic document feeding mechanism and attached to the apparatus body via a pivot shaft to be pivoted for selectively opening/closing the platen glass face and a reading guide attached to the cover means and configured for guiding the document in opposition to the automatic reading area when the cover means is closed. The reading guide has a first end portion close to said pivot shaft attached to be movable to/away from said cover means and a second end portion away from the pivot shaft attached to be immovable to/away from the cover means and an urging means for urging the first end portion of the reading guide toward said automatic reading area.

6 Claims, 8 Drawing Sheets

IMAGE FORMING APPARATUS

CROSS REFERENCE TO RELATED APPLICATIONS

This application claims priority based on the Japanese Patent Application: JP 2005-282576 filed by this Applicant in Japan on Sep. 28, 2005 and the Japanese Patent Application: JP 2006-218517 also filed by this Applicant in Japan on Aug. 10, 2006, the disclosures of which are incorporated herein by reference in their entirety.

BACKGROUND OF THE INVENTION

1. Field of the Invention

The present invention relates to an image forming apparatus including a platen glass face provided in an apparatus body and having a reading area for reading a document set under a stationary condition thereof and an automatic reading area for reading the document while the document is guided past over this automatic reading area by an automatic document feeding mechanism, a cover means mounting the automatic document feeding mechanism and attached to the apparatus body via a pivot shaft to be pivoted for selectively opening/closing the platen glass face, and a reading guide attached to the cover means and configured for guiding the document in opposition to the automatic reading area when the cover means is closed.

2. Description of the Related Art

As an image forming apparatus of the above-noted type, there is known an apparatus in which the reading guide is immovably fixed to the cover means (see. e.g. Japanese Patent Application "Kokai" No. 2002-189319) (this conventional apparatus will be referred to as "First Prior Art" hereinafter).

As such image forming apparatus, there is known another apparatus as shown in FIG. 13 in which the reading guide 4*b* is attached to the cover means 4 via urging means 11 provided respectively at opposed ends thereof, so that this entire guide 4*b* can move to and away from the cover means 4 (see e.g. Japanese Patent Application "Kokai" No. 2001-235909) (this conventional apparatus will be referred to as "Seconds Prior Art" hereinafter).

With the above-described image forming apparatus, in order to be able to accurately read an image on a document while an automatic document feeding mechanism guides the document onto a platen glass face and then guides it through an automatic reading area provided on this face, it is essential that the platen glass face and the reading guide be maintained with a constant distance therebetween over the entire right/left width of the document, in particular, the document being fed be free from any force which may result in displacement thereof to either side.

According to First Prior Art described above, the reading guide is fixed (immovable) to the cover means. Therefore, in order to maintain such proper positional relationship between the platen glass and the reading guide, extremely high precision is required in their positional relationship for avoiding error in the attaching position of the cover means relative to the apparatus body.

In practice, however, due to e.g. the dimensional tolerance of a pivot shaft for the cover means and other parts associated therewith, it is difficult to realize such high precision attachment which maintains a same distance between the apparatus body (platen glass) and the cover means (reading guide) over all portions thereof. As a result, there tends to occur a problem of a portion of the reading guide (in particular, the portion thereof adjacent the pivot shaft) being afloat the platen glass face.

On the other hand, according to Second Prior Art described above, the reading guide is mounted such that the guide, in its entirety, is urged against the platen glass face by the urging means. Therefore, when the cover means is closed, the reading guide can readily assume a posture along the platen glass face. Hence, for example, when the image of the document is read at the automatic reading area with using the automatic document feeding mechanism, an appropriate gap can be maintained therebetween over all portions thereof. On the other hand; however, if the urging force of the urging means is large, this urging force will tend to push the cover means up away from the platen glass. As a result, the distal end portion of the cover means away from the pivot shaft may be pushed afloat the platen glass surface. Then, when the document reading operation is effected by manually placing and keeping the document still at a reading area on the platen glass face, without using the automatic document feeding mechanism, such "floating" cover means may cause a problem in the document reading operation.

Further, the reading guide employed in Second Prior Art is designed to be attached to the cover means with using screws. This fact makes the assembly of the apparatus troublesome and also requires a tool for fixing the screws. And, once the reading guide has been fixed with the screws, the reading guide will not normally be removed. Therefore, when there occurs change in the type and/or thickness of paper sheet material employed, the construction of Second Prior Art can only provide a same urging force to the paper sheet, regardless of its type/thickness.

SUMMARY OF THE INVENTION

In view of the above-described state of the art, a primary object of the present invention is to provide an image forming apparatus which overcomes the above-described drawbacks of the convention, the inventive apparatus allowing a document reading operation to be effected appropriately whether the automatic document feeding mechanism is employed or not and allowing also easy assembly of the apparatus.

For accomplishing the above-noted object, according to one aspect of the present invention, there is provided an image forming apparatus comprising:

a platen glass face provided in an apparatus body and having a reading area for reading a document set under a stationary condition thereof and an automatic reading area for reading the document while the document is guided past over this automatic reading area by an automatic document feeding mechanism;

a cover means mounting said automatic document feeding mechanism and attached to the apparatus body via a pivot shaft to be pivoted for selectively opening/closing the platen glass face;

a reading guide attached to said cover means and configured for guiding the document in opposition to said automatic reading area when said cover means is closed, said reading guide having a first end portion close to said pivot shaft attached to be movable to/away from said cover means and a second end portion away from said pivot shaft attached to be immovable to/away from said cover means; and an urging means for urging said first end portion of the reading guide toward said automatic reading area.

With the above-described apparatus, the first end portion of the reading guide is attached to be movable to/away from the cover means, and there is provided an urging means for urging the first end portion of the reading guide toward the automatic reading area. Accordingly, when the cover means is closed, a necessary and sufficient urging force is applied from the first end portion of the reading guide to the automatic reading area, so that the document can be guided in a reliable manner. On the other hand, although a urging resistive moment is applied to the first end portion of the reading guide, as this first end portion is located close to the pivot shaft, the magnitude of this urging resistive moment is sufficiently smaller than the gravitational moment applied to the platen glass face from the gravity center of the cover means.

Further, the second end portion of the reading guide is attached to be immovable to/away from the cover means. Hence, even when the cover means is closed, no positive urging force is applied from this second end portion of the reading guide to the automatic reading area, so that there is developed no substantial urging resistive moment to the second end portion.

Therefore, in the case of reading an image of the document set still on the platen glass face (this mode of operation will be referred to as "stationary document reading mode"), as the gravitational moment largely exceeds the urging resistive moment, the cover means can be maintained in contact along the platen glass face.

On the other hand, in the case of reading the image of the document on the automatic reading area with using the automatic document feeding mechanism (this further mode operation will be referred to as the "automatic document reading mode"), as the reading guide reliably guides the document, there occurs no reading trouble such as paper jam.

Further, with the image forming apparatus having the above-described construction, there is no need for fine adjustment for the purpose of preventing "floating-off" of the cover means. In order to constantly ensure appropriate document reading operation, the following two conditions need to be met, namely, a condition of "a gravitational moment applied from the gravity center of the cover means to the platen glass face being greater than the urging resistive moment applied to the reading guide" (First Condition) and a further condition of "an upward force applied to the reading guide during document transportation being smaller than the urging force applied by the urging means of the first end portion of the reading guide to urge the reading guide to the automatic reading area (Second Condition). First Condition is a condition required under the stationary document reading mode. Second Condition is a condition required under the automatic document reading mode. The urging resistive moment relating to First Condition is generated from a portion of the cover means adjacent the pivot shaft. Therefore, even if the urging force of the urging means for the first end portion of the reading guide is set sufficiently large, the urging resistive moment developed at the first end side will not be so large. Accordingly, there is no need for precision setting of the urging force of the urging means for the first end portion. Instead, urging force can simply be set sufficiently large. And, by setting the urging force sufficiently large, the Second Condition can be met. In this way, according to the above-described construction of the present invention, it is possible to set a sufficiently large urging force to satisfy the Second Condition. Hence, the floating of the cover means can be prevented reliably, without any precision adjustment. Further, as the urging force applied to the reading guide is sufficiently large, there will occur no change in the height of the space or gap through which the document is caused to pass (i.e. the gap distance between the reading guide and the automatic reading area on the platen glass face). Therefore, the automatic image reading operations of the documents can proceed in a smooth and reliable manner and with clarity of the images.

In the image forming apparatus of the present invention, a transport cover of said automatic document feeding mechanism may be attached to said cover means to be opened and closed, and there may be provided a releasing mechanism operable to release the urging force of said urging means in operative association with opening/closing of said transport cover.

With the image forming apparatus having the above-described construction, there is provided a releasing mechanism operable to release the urging force of the urging means in operative association with opening/closing of the transport cover of the automatic document feeding mechanism provided in the cover means.

For instance, the urging means can be a coil spring and this coil spring can be constantly compressed by a compressing member constituting the releasing mechanism. Further, the compressing member can be operably coupled with the transport cover.

Then, if a paper jam occurs within the automatic document feeding mechanism, the transport cover will be opened. In association with this opening operation, the compressing member will substantially simultaneously release the compression of the coil spring, thereby releasing the urging force applied from the reading guide to the automatic reading area, so that the paper jammed inside the automatic document feeding mechanism can be removed easily.

In the image forming apparatus of the present invention, the reading guide can be attached to said cover means via a joint member having a guide side attaching portion which is attachable to and detachable from the reading guide and a cover side attaching portion which is attachable to and detachable from the cover means.

With the image forming apparatus having the above-described construction, when the reading guide is to be attached to the cover means, if the joint member is provided in the cover means in advance, the attachment can be done simply by attaching the reading guide to the guide side attaching portion of the joint member. For instance, if an engaging hole is provided in the reading guide and a engaging claw is provided in the joint member, then, the attachment can be done by a simple one-touch operation of engaging the engaging claw into the engaging hole.

Also, detachment of the reading guide from the cover means can be done simply by pulling the engaging claw out of the engaging hole with fingers or the like and then sliding the reading guide.

As described above, with this construction of attaching the reading guide to the cover means via the joint member, the attaching and detaching operations of the reading guide do not require any special tool or skill of an experienced worker. Yet, the assembly and maintenance operations, etc. can be done easily and reliably.

Further, as the joint member includes the cover side attaching portion which is attachable to and detachable from the cover means, this joint member per se may be replaced by a different one. This will provide the possibility of optionally incorporating an urging means having an optimum particular elasticity in the joint member or selectively the particular material for forming the joint member in accordance with thickness, type of material etc. of the paper sheet to employed in the image forming apparatus.

According to a further aspect of the present invention, there is provided an image forming apparatus comprising:

a platen glass face provided in an apparatus body and having a reading area for reading a document set under a stationary condition thereof and an automatic reading area for reading the document while the document is guided past over this automatic reading area by an automatic document feeding mechanism;

a cover means mounting said automatic document feeding mechanism and attached to the apparatus body via a pivot shaft to be pivoted for selectively opening/closing the platen glass face;

a reading guide attached to said cover means and configured for guiding the document in opposition to said automatic reading area when said cover means is closed, said reading guide having a first end portion close to said pivot shaft attached to be movable to/away from said cover means and a second end portion away from said pivot shaft attached to be movable to/away from said cover means; and a first urging means and a second urging means for urging said first end portion and said second end portion of the reading guide toward said automatic reading area, respectively, urging forces of said first urging means and said second urging means being set such that an urging resistive moment applied to said entire reading guide when the cover means is closed is smaller than a gravitational moment applied to said platen glass face from the center of gravity of said cover means and also that an urging resistive moment applied to said second end portion is smaller than said urging resistive moment applied to said first end portion.

With the above-described apparatus, the first end portion and the second end portion of the reading guide are attached to be movable to/away from the cover means, respectively. Further, there are provided a first urging means and a second urging means for urging the first end portion and the second end portion of the reading guide toward the automatic reading area, respectively. Now, when the cover means is closed, as the reading guide is urged against the automatic reading area, a necessary and sufficient urging force can be applied from the reading guide to the automatic reading area, so that the document can be guided in a reliable manner. On the other hand, although urging resistive moments are applied to both the first end portion and the second end portion of the reading guide, the urging forces of the first urging means and the second urging means are set such that the urging resistive moment applied to the entire reading guide is smaller than a gravitational moment applied to the platen glass face from the center of gravity of the cover means and also that an urging resistive moment applied to the second end portion is smaller than said urging resistive moment applied to the first end portion.

With such setting, in the stationary document reading mode, the cover means can be maintained in contact along the platen glass face, and in the automatic document reading mode, the reading guide can reliably guide the document while maintaining the urging condition of the automatic reading area.

Incidentally, in the automatic document reading mode, an upward force may be applied to the reading guide during the reading operation, due to the transporting speed or thickness of the paper, etc. However, unless such upward force exceeds the urging force applied by the urging means for urging the reading guide toward the automatic reading area, the reading guide will not float off the automatic reading area. In the case of the above-described construction, because of the nature of this construction, there is hardly developed a large urging resistive moment at the first end portion of the reading guide, so that the urging force of the urging means for the first end portion can be set sufficiently large to well exceed the above-described upward force. For this reason, there will occur no change in the height of the space or gap through which the document is caused to pass (i.e. the gap distance between the reading guide and the automatic reading area on the platen glass face).

Therefore, with the image forming apparatus having the above-described construction, in both the stationary document reading mode and the automatic reading mode, the image reading operation of the documents can proceed without any reading trouble, in a smooth and reliable manner and with clarity of the images.

In the image forming apparatus of the present invention, a transport cover of said automatic document feeding mechanism may be attached to said cover means to be opened and closed, and there may be provided a releasing mechanism operable to release the urging forces of said first and second urging means in operative association with opening/closing of said transport cover.

With the image forming apparatus having the above-described construction, there is provided a releasing mechanism operable to release the urging forces of the first and second urging means in operative association with opening/closing of the transport cover of the automatic document feeding mechanism provided in the cover means.

For instance, the first and second urging means can each be a coil spring and this coil spring can be constantly compressed by a compressing member constituting the releasing mechanism. Further, the compressing member can be operably coupled with the transport cover.

Then, if a paper jam occurs within the automatic document feeding mechanism, the transport cover will be opened. In association with this opening operation, the compressing member will substantially simultaneously release the compression of the coil spring, thereby releasing the urging force applied from the reading guide to the automatic reading area, so that the paper jammed inside the automatic document feeding mechanism can be removed easily.

In the image forming apparatus of the present invention, the reading guide can be attached to said cover means via a joint member having a guide side attaching portion which is attachable to and detachable from the reading guide and a cover side attaching portion which is attachable to and detachable from the cover means.

With the image forming apparatus having the above-described construction, when the reading guide is to be attached to the cover means, if the joint member is provided in the cover means in advance, the attachment can be done simply by attaching the reading guide to the guide side attaching portion of the joint member. For instance, if an engaging hole is provided in the reading guide and an engaging claw is provided in the joint member, then, the attachment can be done by a simple one-touch operation of engaging the engaging claw into the engaging hole.

Also, detachment of the reading guide from the cover means can be done simply by pulling the engaging claw out of the engaging hole with fingers or the like and then sliding the reading guide.

As described above, with this construction of attaching the reading guide to the cover means via the joint member, the attaching and detaching operations of the reading guide do not require any special tool or skill of an experienced worker. Yet, the assembly and maintenance operations, etc. can be done easily and reliably.

Further, as the joint member includes the cover side attaching portion which is attachable to and detachable from the cover means, this joint member per se may be replaced by a different one. This will provide the possibility of optionally incorporating an urging means having an optimum particular elasticity in the joint member or selectively the particular material for forming the joint member in accordance with thickness, type of material etc. of the paper sheet to employed in the image forming apparatus.

DETAILED DESCRIPTION OF THE INVENTION

Figure 1:
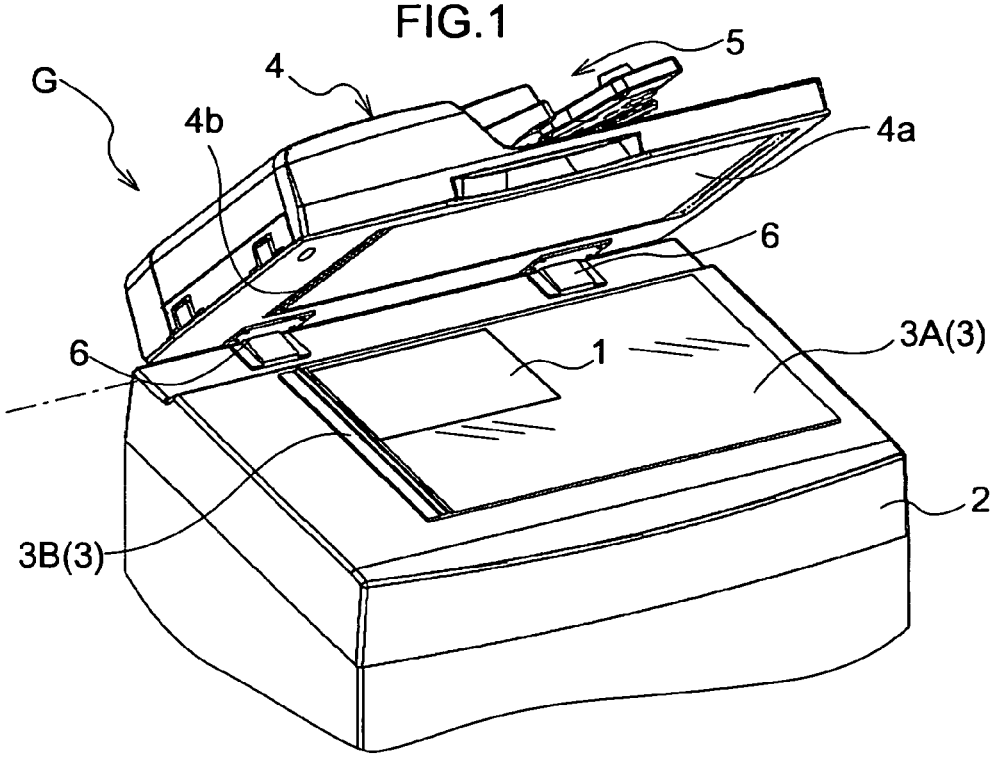
FIG. 1 is a perspective view showing an image forming apparatus.

Preferred embodiments of the present invention will be described with reference to the accompanying drawings. In these drawings, components/members identical to corresponding components/member employed in the conventional construction are denoted with identical reference numerals/marks.

Figure 2:
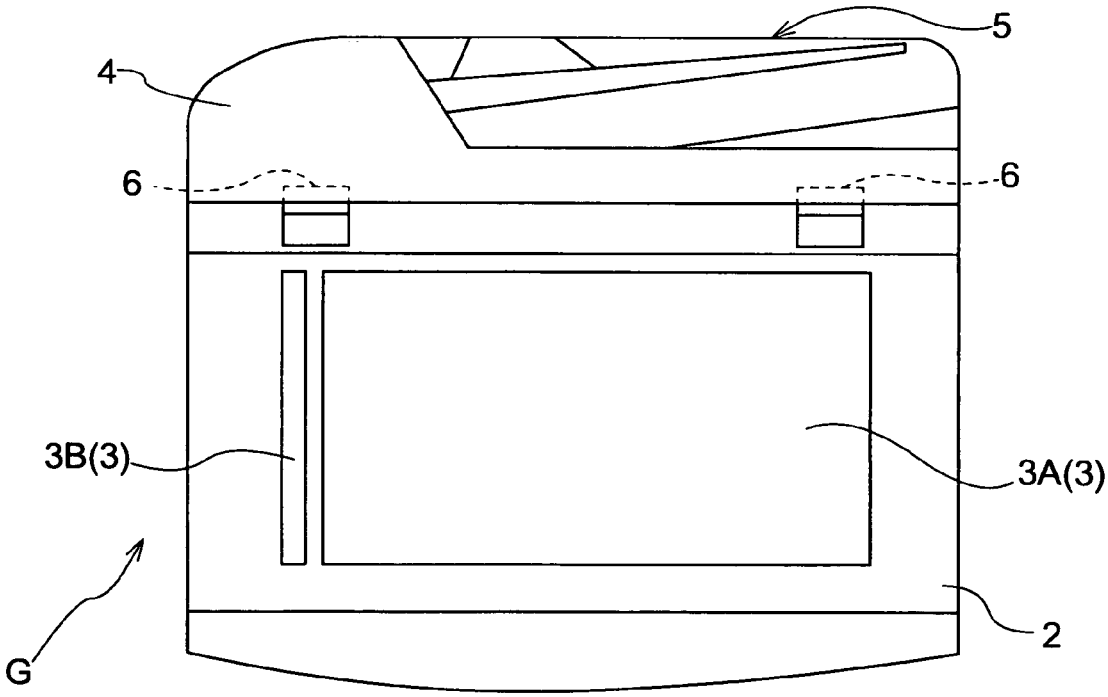
FIG. 2 is a plan view showing the image forming apparatus, with its cover means being open up.

FIGS. 1 and 2 both show an image forming apparatus relating to a one embodiment of the present invention. Some non-limiting examples of this type of image forming apparatus are a copier, a scanner, a facsimile, etc. According to one mode of operation ("stationary document reading mode") of this apparatus, a document (original) 1 to be read is set still on a reading area 3A provided on a platen glass 3 face of an apparatus body 2 and then a cover means 4 is closed. Under this condition, an image of the document 1 is read by applying a scanning beam thereon. Alternatively ("automatic document reading mode"), under the closed condition of the cover means 4, a document 1 may be set to an automatic document feeding mechanism 5 mounted to the cover means 4, which then guides this document 1 to and across an automatic reading area 3B provided on the platen glass 3 face, in the course of which the scanning beam is applied to the document for reading the image thereon. In these ways, the apparatus is capable of reading an image in two kinds of modes.

Incidentally, though not shown, under the platen glass 3, there are provided various mechanisms and units for reading the image of the document 1 and then transferring and fixing it on a transfer paper sheet.

On the top face of the apparatus body 2, there is provided the platen glass 3 as a document setting portion. This platen glass 3, as shown, is divided into two sections, one of which occupying most of the area, is constructed as the reading area 3A on which documents 1 of various sizes can be set.

The other portion provided in the form of a narrow elongate section adjacent one side of the reading area 3A is constructed as the automatic reading area 3B, across which the document 1 can be caused to pass as being guided by the automatic document feeding mechanism 5.

Figure 4:
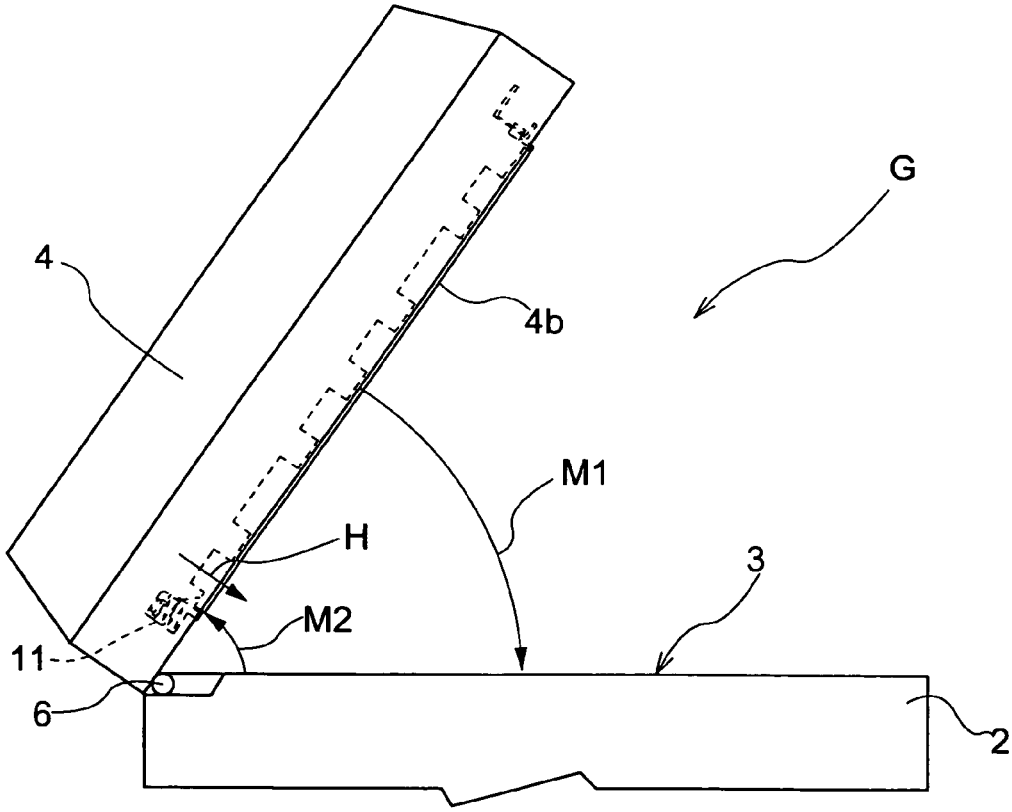
FIG. 4 is a explanatory view of the image forming apparatus shown from its left side.

The cover means 4, as shown in FIG. 4, is attached to the apparatus body 2 via pivot shafts 6 so that the cover means 4 can be pivoted to selectively open/close the platen glass 3 face.

Incidentally, the axial direction of the pivot shafts 6 is aligned with the direction of adjacency of the reading area 3A relative to the automatic reading area 3B. Further, in the plan view of FIG. 2, the lower side corresponds to the "front side" of the apparatus, the upper side of the view corresponds to the "rear side" of the apparatus, the right and left sides of the view correspond respectively to the "right side" and "left side" of the apparatus. Hereinafter, these will be referred simply as "front side", "rear side", "right side" and "left side", respectively.

Therefore, the cover means 4, with its rear side portion is attached to the apparatus body 2 via the pivot shafts 6. When an operator grips the front side portion of the cover means 4 and moves it up/down, the cover means 4 is pivoted up/down about the pivot shafts 6. As this cover means 4 has a planar area slightly larger than that of the platen glass 3, the cover means 4, when moved downward, can cover the entire area of the platen glass 3, thus closing it.

Further, the cover means 4 includes, in its lower face, a covering portion 4*a* designed to over the reading area 3A and a reading guide 4*b* disposed in opposition to the automatic reading area 3B (see FIG. 1). The reading guide 4*b* is attached to be projectable/retractable relative to the cover means 4. The language "projectable/retractable" is employed herein to mean that at least a portion of the reading guide 4*b* can be projected from the lower face position of the cover means 4 or retracted to the lower face position of the cover means 4.

Figure 3:
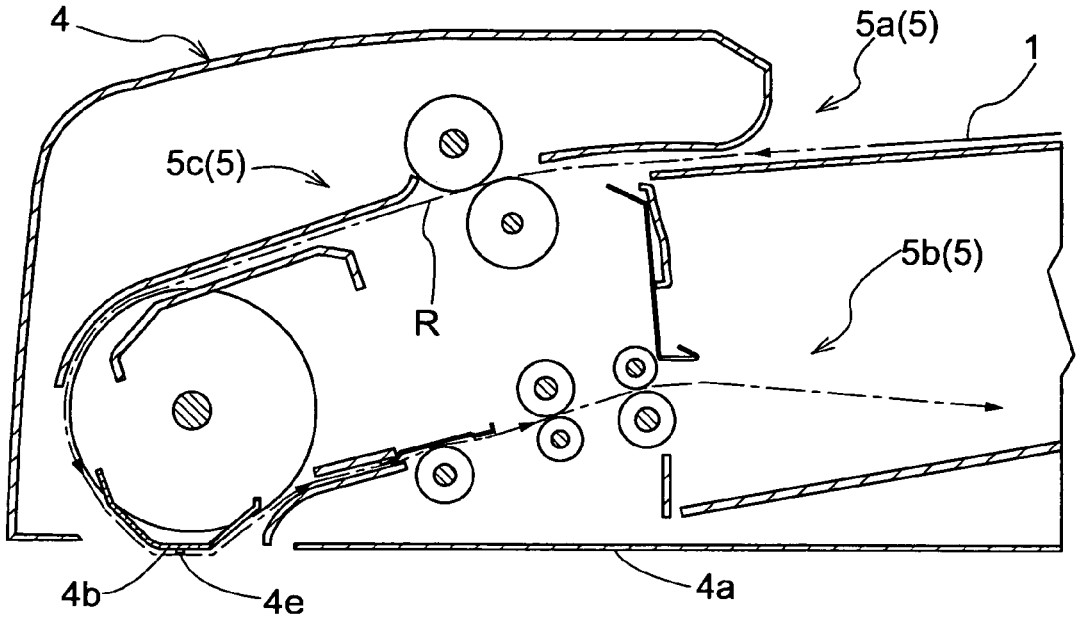
FIG. 3 is a conceptual diagram showing an automatic document feeding mechanism in section as seen from the front side of the image forming apparatus.

As shown in FIG. 3, the automatic document feeding mechanism 5 includes a shelf-like feeding document setting portion 5*a* and a document receiving portion 5*b* which are disposed one above the other at the center section of the cover means 4, and a document feeding means 5*c* configured to guide the document 1 along a document feeding path R indicated by an arrow with a set of components such as rollers, belts, a sensor, a motor, etc. accommodated within the cover means 4.

The reading guide 4*b* is disposed at a position on the document feeding path R.

This reading guide 4*b*, as shown, is formed of a thin plate having a substantially U-shaped cross section. In operation, the reading guide 4*b* guides, with its lower face, the document 1 being transported along the document feeding path R by the automatic document feeding mechanism 5, so as to prevent inadvertent detachment or "floating" of the document off the surface of the automatic reading area 3B of the platen glass 3, thus ensuring required precision for the image reading operation.

More particularly, when the cover means 4 having the reading guide 4*b* attached thereto is closed, from one end portion (this end portion will be referred to as "first end portion") 4*ba* of the reading guide 4*b* closer to the pivot shaft 6 to the other end portion away from the pivot shaft 6 (this other end portion will be referred to as "second end portion") 4*bb* of the reading guide 4*b*, there is exerted an urging force which urges the entire reading guide 4*b* or a portion thereof toward the automatic reading area 3B. In response to this urging force, there is developed an urging resistive moment in the reading guide 4*b*. On the other hand, there is also exerted a gravitational moment from the center of gravity of the cover means 4 toward the platen glass 3 face. In this regard, according to the essential concept of the present invention, the urging resistive moment is set smaller than the gravitational moment. With establishment of such relationship between the moments, in the case of reading an image of the document 1 set still on the platen glass 3 face (stationary document reading mode), the cover means 4 can be maintained in contact with/along the platen glass 3 face. That is, the covering portion 4*a* provided in the lower face of the cover means 4 is placed in contact with/along the platen glass 3 face via the document 1 interposed therebetween. Therefore, there occurs no image reading trouble due to insufficient pressing, etc., so that the document reading operation can be effected in a reliable manner and with good clarity.

On the other hand, in the case of reading the image of the document 1 on the automatic reading area 3B with using the automatic document feeding mechanism 5 (the automatic document reading mode), in this case too, when the cover means 4 is closed, the reading guide 4*b* is urged (pressed) against the automatic reading area 3B with the above-described urging force. Therefore, due to the necessary and sufficient urging force applied from the reading guide 4*b* to the automatic reading area 3B, the document 1 can be guided in a reliable manner.

Incidentally, in the automatic document reading mode, an upward force may be applied to the reading guide 4*b* during the reading operation, due to the transporting speed or thickness of the paper, etc. However, unless such upward force exceeds the urging force, the reading guide 4*b* will not float off the automatic reading area 3B. In the case of the above-described construction, because of the nature of this construction, there is hardly developed a large urging resistive moment at the first end portion 4*ba* of the reading guide 4*b*, so that the urging force on the first end portion 4*ba* side of the reading guide 4*b* can be set sufficiently large, hence, the urging force can be set sufficiently large to well exceed the above-described upward force. For this reason, there will occur no change in the height of the space or gap through which the document is caused to pass (i.e. the gap distance between the reading guide 4*b* and the automatic reading area 3B on the platen glass 3 face). For forming such gap distance, it is effective to provide gap forming projections 4*e* adjacent the opposed ends of the lower face of the reading guide 4*b*.

Therefore, if automatic image reading operations of a plurality of documents 1 are effected continuously under such pressed condition as described above, there will occur no such image reading trouble as paper jamming, so that the automatic image reading operations of the documents 1 can proceed in a smooth and reliable manner and with clarity of the images.

Next, embodiments relating to various modes of attachment of the reading guide 4*b* to the cover means 4 will be specifically described.

First Embodiment

Figure 5:
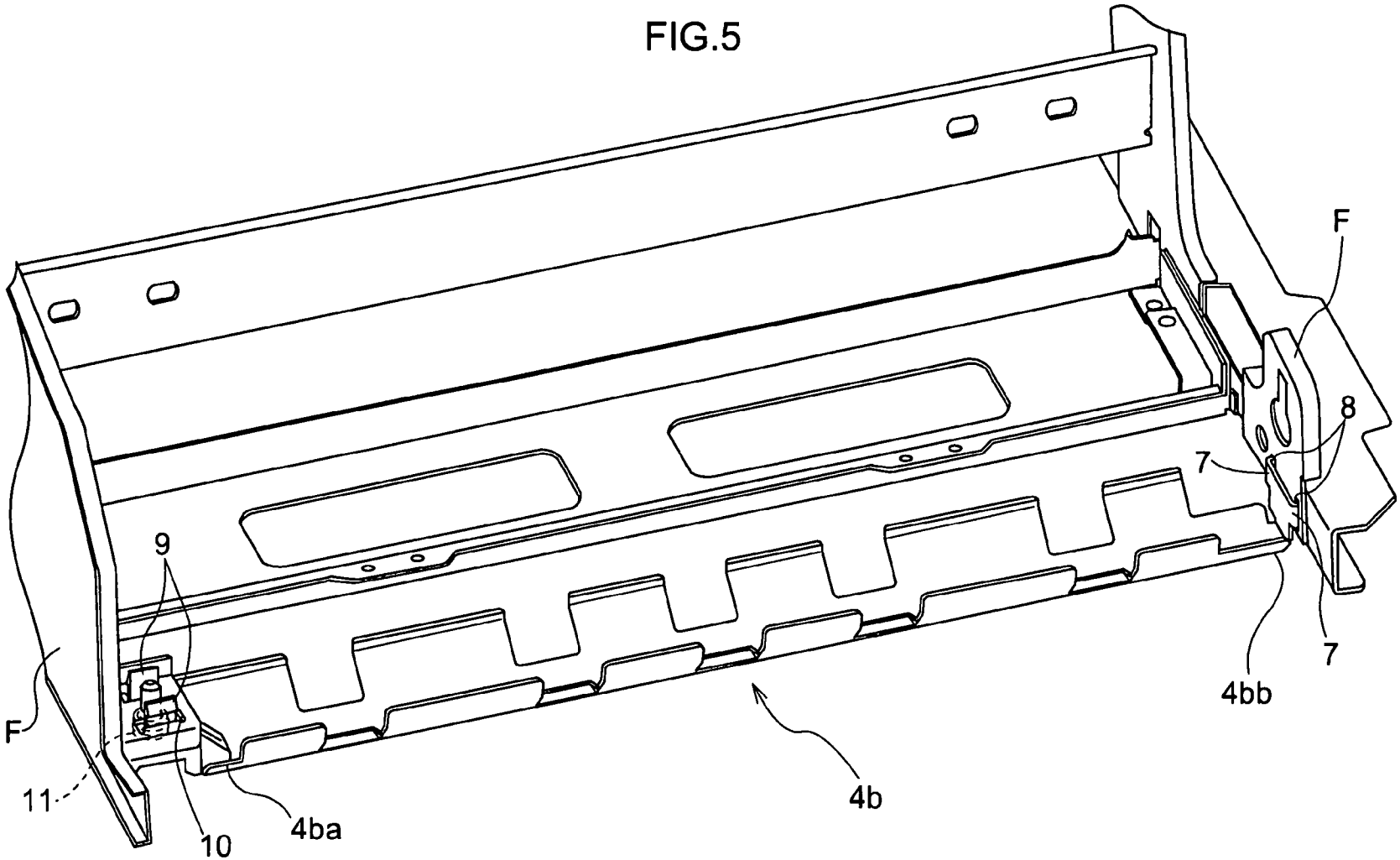
FIG. 5 is a perspective view of principal portion showing a mode of attachment of a reading guide to a frame according to a first embodiment.
Figure 6:
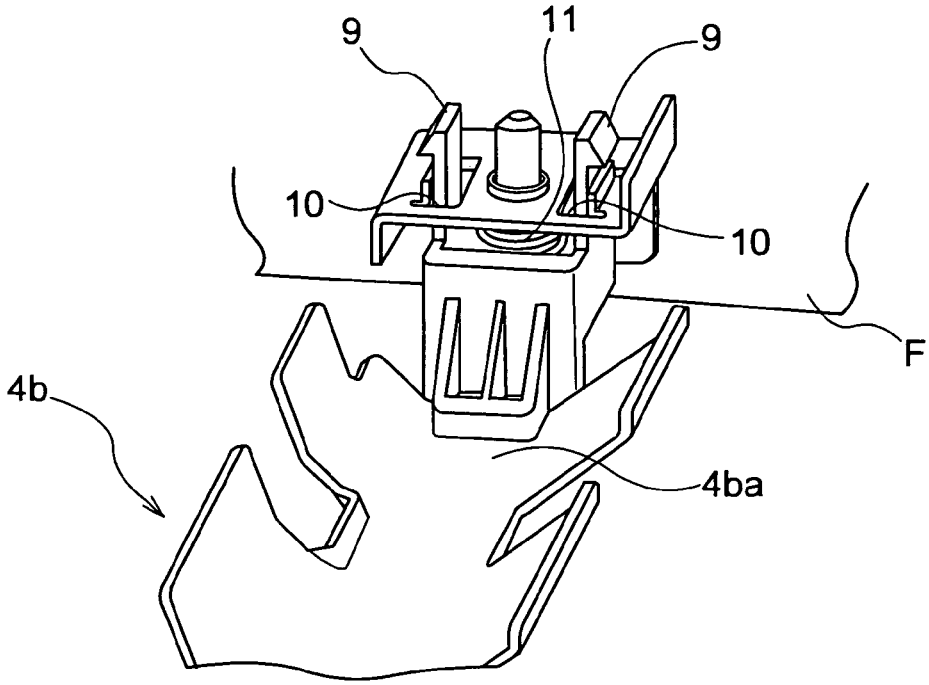
FIG. 6 is a detailed view of a first end portion of the reading guide.

FIG. 5 is a perspective view of principal portion showing a mode of attachment of the reading guide 4*b* to a frame F of the cover means 4 according to a first embodiment. FIG. 6 is a detailed view of the first end portion 4*ba* of the reading guide 4*b* and FIG. 7 is a detailed view of the second end port ion 4*bb* of the reading guide 4*b*.

In this first embodiment, the first end portion 4*ba* (including its vicinity) of the reading guide 4*b* is attached to be movable toward/away from the cover means 4. Further, there is provided an urging means for urging the first end portion 4*ba* toward the automatic reading area 3B. On the other hand, the second end portion 4*bb* (including its vicinity) of the reading guide 4*b* is attached to be immovable relative to the cover means 4.

As shown in FIG. 6, at the first end portion 4*ba* of the reading guide 4*b*, there are provided first engaging claws 9 projecting along the height thereof. At corresponding opposing portions of the frame F, there are defined first retaining holes 10 into which the respective first engaging claws 9 can engage along their projecting direction. Then, by engaging the first engaging claws 9 upwardly into the first retaining holes 10 from the under side thereof, the reading guide 4*b* can be fixed to be vertically movable relative to the frame F. Further, between the first end portion 4*ba* and the frame F, there is provided a coil spring (corresponding to the "urging means") 11 configured to exert a reaction force to the frame F for urging and pressing the reading guide 4*b* against the platen glass 3.

Figure 7:
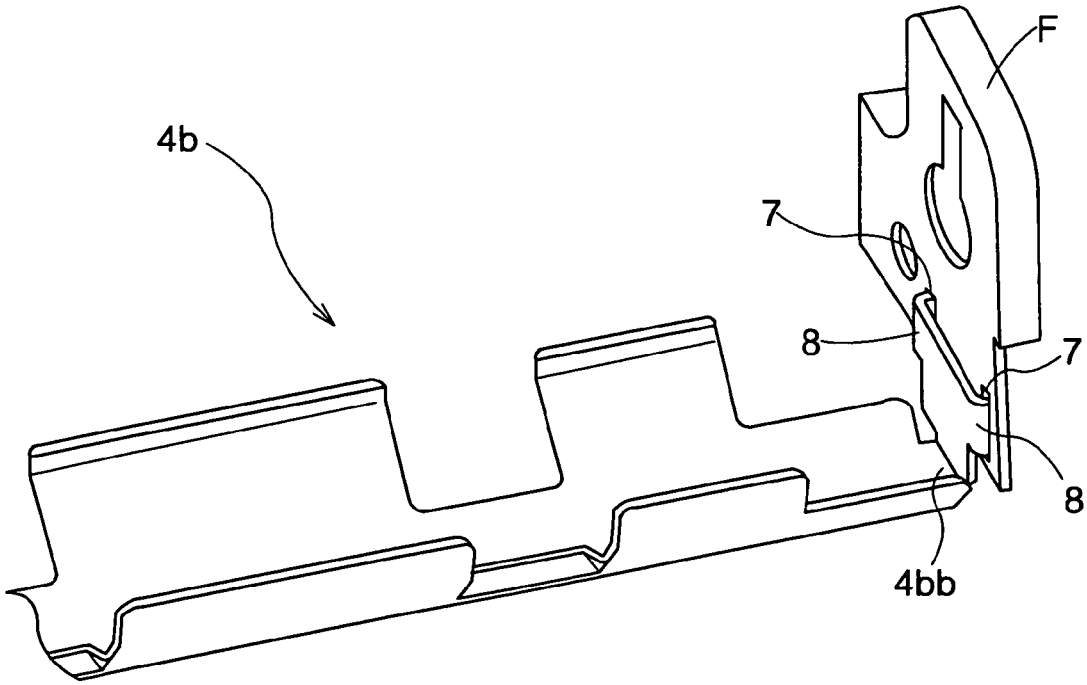
FIG. 7 is a detailed view of a second end portion of the reading guide.

On the other hand, as shown in FIG. 7, at the second end portion 4*bb* of the reading guide 4*b*, there is formed a second engaging claw 8 projecting along the length of the reading guide 4*b*. At a corresponding portion of the cover means 4 opposing to the frame F, there is formed a second retaining hole 7 into which the second engaging claw 8 can engage along its projecting direction. Then, by engaging the second engaging claw 8 into the second retaining hole 7, the reading guide 4*b* can be fixed to the cover means 4 to be immovable relative to (to/away from) the cover means 4. Incidentally, the second retaining hole 7 can be formed slightly larger than the second engaging claw 8, so as to allow slight pivotal movement of the second end portion 4*bb* side of the reading guide 4*b* relative to the cover means 4. Such alternative construction of providing small "play" between the second engaging claw 8 and the second retaining hole 7 too is understood to be included in the concept of what is referred to as fixing" herein.

If the second end portion 4*bb* side is fixed as described above, even when the cover means 4*b* is closed, there will be exerted no positive urging force from the second end portion 4*bb* toward the automatic reading area 3B. Therefore, substantially no urging resistive moment is developed on this second end portion 4*bb* side.

In the first embodiment having the first end portion 4*ba* and the second end portion 4*bb* above-described, as the first end portion 4*ba* side of the reading guide 4*b* is attached to be movable to/away from the cover means 4 and the coil spring 11 is provided as the urging means, then, when the cover means 4 is closed, a necessary and sufficient urging force is applied from the reading guide 4B to the automatic reading area 3B, so that the document can be guided in a reliable manner. Further, although the urging resistive moment acts on the first end portion 4*ba* of the reading guide 4*b*, as this first end portion 4*ba* side is close to the pivot shaft 6, the magnitude of the above-described urging resistive moment is sufficiently smaller than the gravitational moment exerted from the center of gravity of the cover means 4 to the platen glass 3 face. For this reason, under the closed condition of the cover means 4, regarding the moment about the pivot shaft 6, the closing direction-wise moment M1 due to the weight of the cover means 4 significantly exceeds the opening direction-wise moment M2 due to the urging force of the coil spring 11 (see FIG. 4). As a result, the cover means 4 can be located at the appropriate position along the platen glass 3 face at both the reading area 3A and the automatic reading area 3B.

Therefore, with the image forming apparatus according to the first embodiment, in the stationary document reading mode, the cover means 4 can be maintained under the appropriate condition in contact with/along the platen glass 3 face. That is, as the covering portion 4*a* provided in the lower face of the cover means 4 is placed in close contact with the platen glass 3 face via the document 1, the reading operation of the document 1 can be effected in a reliable manner and with good imaging clarity. On the other hand, in the automatic document reading mode, the reading guide 4*b* is urgedly pressed against the automatic reading area 3B. Therefore, due to the necessary and sufficient urging force applied from the reading guide 4*b* to the automatic reading area 3B, the document 1 can be guided in a reliable manner.

Further, with the image forming apparatus according to this embodiment, there is no need for fine adjustment for the purpose of preventing "floating-off" of the cover means 4. In order to constantly ensure appropriate document 1 reading operation, the following two conditions need to be met, namely, a condition of "a gravitational moment applied from the gravity center of the cover means 4 to the platen glass 3 face being greater than the urging resistive moment applied to the reading guide 4*b*" (First Condition) and a further condition of "an upward force applied to the reading guide 4*b* during document transportation being smaller than the urging force applied by the coil spring 11 of the first end portion 4*ba* of the reading guide 4*b* to urge the reading guide 4*b* to the automatic reading area 3B (Second Condition). First Condition is a condition required under the stationary document reading mode. Second Condition is a condition required under the automatic document reading mode. The urging resistive moment relating to First Condition is generated from a portion of the cover means 4 adjacent the pivot shaft 6. Therefore, even if the urging force of the coil spring 11 for the first end portion 4*ba* of the reading guide 4*b* is set sufficiently large, the urging resistive moment developed at the first end 4*ba* side will not be so large. Accordingly, there is no need for precision setting of the urging force of the coil spring 11 for the first end portion 4*ba*. Instead, urging force can simply be set sufficiently large. And, by setting the urging force of the coil spring 11 sufficiently large, the Second Condition can be met. In this way, according to the above-described construction of the present embodiment, it is possible to set a sufficiently large urging force to satisfy the Second Condition. Hence, the floating of the cover means 4 can be prevented reliably, without any precision adjustment. Further, as the urging force applied to the reading guide 4*b* is sufficiently large, there will occur no change in the height of the space or gap through which the document 1 is caused to pass (i.e. the gap distance between the reading guide 4*b* and the automatic reading area 3B on the platen glass 3 face). Therefore, the automatic image reading operations of the documents 1 can proceed in a smooth and reliable manner and with clarity of the images.

Incidentally, for forming such gap distance, the gap forming projections 4*e* are provided adjacent the opposed ends of the lower face of the reading guide 4*b*. With this, there is formed the gap for automatic feeding of the paper between the reading guide 4*b* an the automatic reading area 3B.

Therefore, with the image forming apparatus according to the first embodiment, in both the stationary document reading mode and the automatic reading mode, the image reading operation of the documents can proceed without any reading trouble, in a smooth and reliable manner and with clarity of the images.

Second Embodiment

Figure 8:
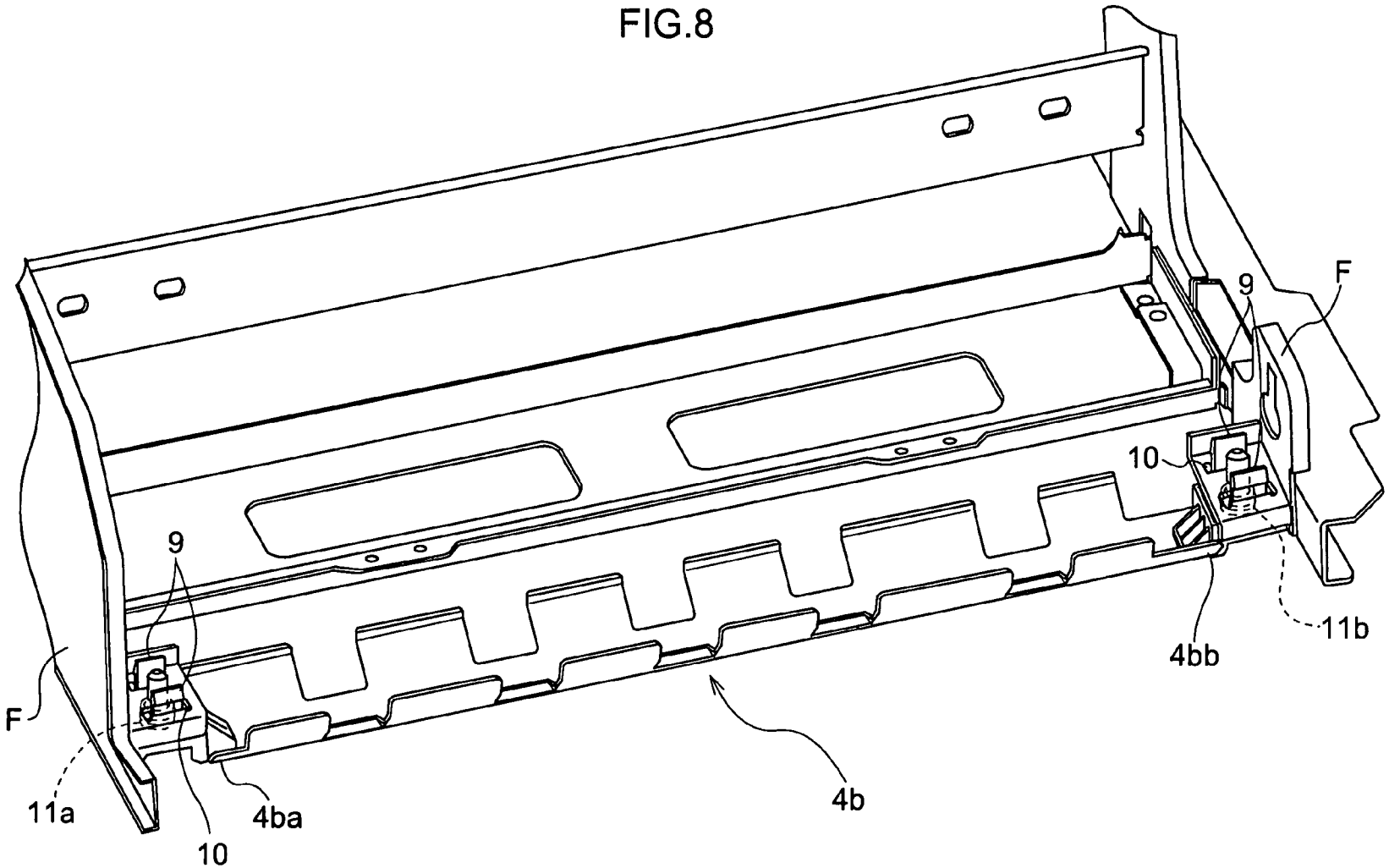
FIG. 8 is a perspective view of principal portion showing a mode of attachment of the reading guide to the frame according to a second embodiment.

FIG. 8 is a perspective view of principal portion showing a further mode of attachment of the reading guide 4*b* to the frame F of the cover means 4 according to a second embodiment.

In this second embodiment, both the first end portion 4*ba* side and the second end portion 4*bb* side of the reading guide 4*b* are attached to be movable to/away from the cover means 4. And, a first coil spring (corresponding to "first urging means") 11*a* and a second coil spring (corresponding to "second urging means") 11*b* are provided for urging the first end portion 4*ba* side and the second end portion 4*bb* side toward the automatic reading area 3B, respectively. The specific construction for attaching the first end portion 4*ba* and the second end portion 4*bb* of the reading guide 4*b* to the frame 4 of the cover means 4 is identical to the attaching construction of the first end portion 4*ba* side in the above-described first embodiment.

In this second embodiment, the respective urging forces of the first coil spring 11*b* and the second coil spring 11*b* are set such that an urging resistive moment applied to the entire reading guide 4*b* when the cover means 4 is closed is smaller than a gravitational moment applied to the platen glass 3 face from the center of gravity of the cover means 4 and also that an urging resistive moment applied to the second end portion 4*bb* is smaller than the urging resistive moment applied to said first end portion 4*ba*.

With the above-described setting, in the stationary document reading mode, the cover means 4 can be maintained under the appropriate condition in contact with/along the platen glass 3 face. That is, as the covering portion 4*a* provided in the lower face of the cover means 4 is placed in close contact with the platen glass 3 face via the document 1, the reading operation of the document 1 can be effected in a reliable manner and with good imaging clarity. On the other hand, in the automatic document reading mode, the reading guide 4*b* is urgedly pressed against the automatic reading area 3B. Therefore, due to the necessary and sufficient urging force applied from the reading guide 4*b* to the automatic reading area 3B, the document 1 can be guided in a reliable manner. Incidentally, in the automatic document reading mode, the upward force applied to the reading guide 4*b* due the transporting speed or thickness of the paper will not be a significant problem as described above. Further, by providing the gap forming projections 4*e* in the bottom of the reading guide 4*b*, there is formed the gap for automatic feeding of papers between the reading guide 4*b* and the automatic reading area 3B.

In this way, according to the image forming apparatus of the second embodiment, in both the stationary document reading mode and the automatic document reading mode, there will occur no document reading trouble, so that the document 1 image reading operation may be effected in a smooth and reliable manner and with clarity of the images.

Third Embodiment

Figure 9:
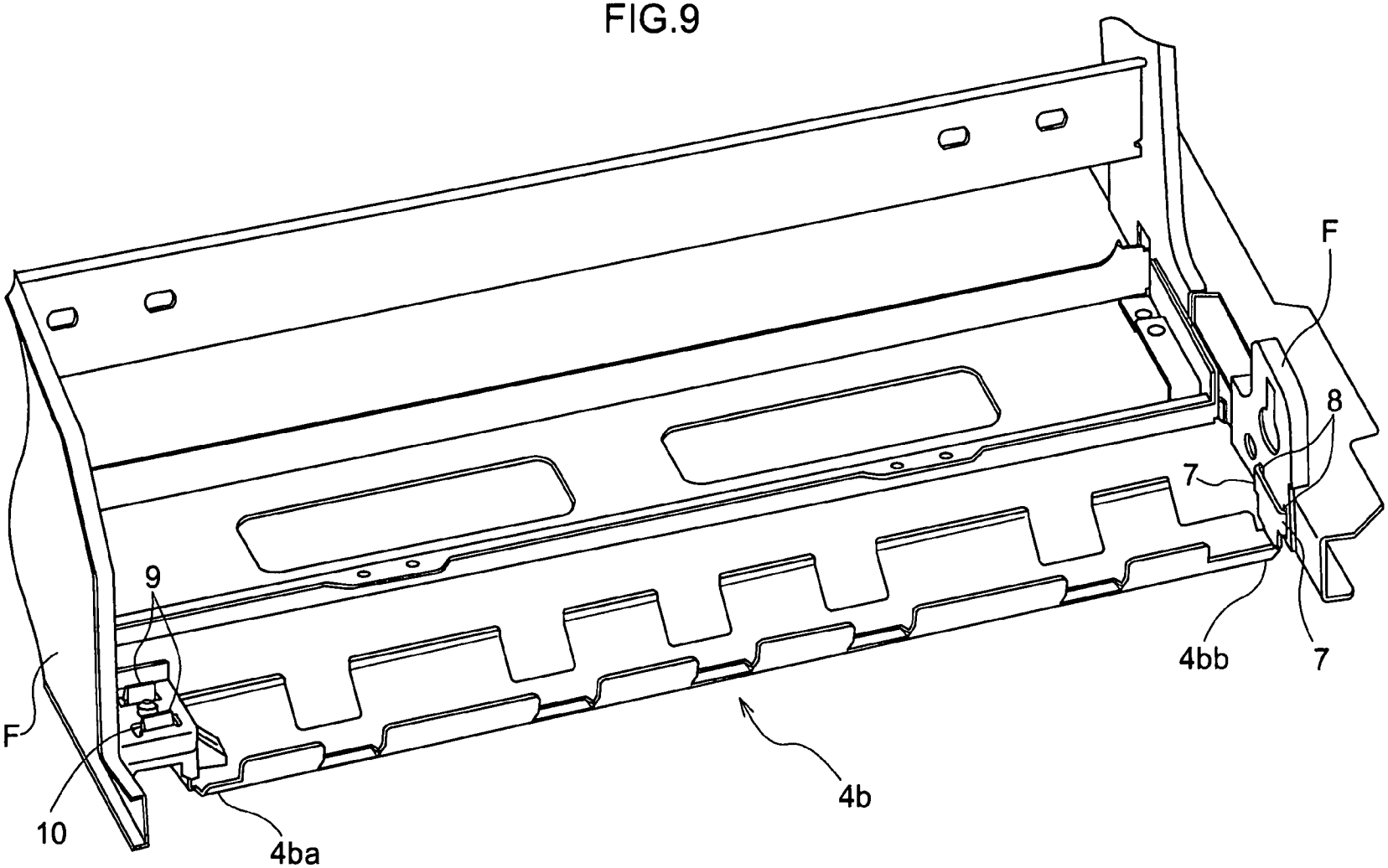
FIG. 9 is a perspective view of principal portion showing a mode of attachment of the reading guide to the frame according to a third embodiment.

FIG. 9 is a perspective view of principal portion showing a further mode of attachment of the reading guide 4*b* to the frame F of the cover means 4 according to a third embodiment.

In this third embodiment, the first end portion 4*ba* side is attached to be movable to/away from the cover means 4, whereas the second end portion 4*bb* side is attached to be immovable relative to the cover means 4, but no urging means is provided in the reading guide 4*b*. Namely, the reading guide 4*b* of this third embodiment is identical to a modified construction of the reading guide 4*b* of the first embodiment shown in FIG. 5, with omission of the coil spring 11 provided on the first end portion 4*ba* side thereof.

When the cover means 4 is closed, due to the dead load of the reading guide 4*b*, the first end portion 4*ba* side thereof slightly project from the lower face position (the position of the covering portion 4*a*) of the cover means 4. Under the closed condition of the cover means 4, the first end portion 4*ba* side of the reading guide 4*b* comes into contact with the automatic reading area 3B of the platen glass 3 face and then is retracted with maintaining contact, to the lower face position of the cover means 4. On the other hand, as the second end portion 4*bb* side of the reading guide 4*b* is located at substantially same level as the lower face position of the cover means 4 regardless of the open/closed condition of the cover means 4, this portion comes into contact with the automatic reading area 3B when the cover means 4 is closed. Therefore, when the cover means 4 is closed, the reading guide 4*b* is retracted from the above-described projecting condition to the lower face position of the cover means 4 and both the first end portion 4*ba* side and the second end portion 4*bb* side of the reading guide 4*b* come into contact with the automatic reading area 3B. In this, if the gap forming projections 4*e* are provided at the bottom of the reading guide 4*b*, there is created the gap or space for automatic feeding of the papers between the reading guide 4*b* and the automatic reading area 3B.

Also, between the cover means 4 and the platen glass 3 face, no other force than the force exerted by the dead load of the cover means 4 is applied. Hence, the cover means 4 is maintained under its condition along the platen glass 3 face.

Therefore, according to this third embodiment, in both the stationary document reading mode and the automatic document reading mode, there will occur no document reading trouble, so that the document image reading operation may be effected in a smooth and reliable manner and with clarity of the images.

Further, since the urging means per se is not provided in this embodiment, there is no need for effecting e.g. fine adjustment for preventing floating up of the cover means 4. For this reason, the automatic reading operation of the documents 1 can be carried out easily and e.g. the maintenance operation can be simple. Moreover, the apparatus construction can be simple and can be manufactured at lower costs.

[Joint Member]

For attaching the reading guide 4*b* to the cover means 4, the first end portion 4*ba* side of the reading guide 4*b* of the first through third embodiments described above or the second end portion 4*bb* side of the reading guide 4*b* of the second embodiment may be attached via a joint member 20. That is, this joint member 20 is provided as a separate component, which is attachable to and detachable from the cover means 4 and the reading guide 4*b*.

Figure 10:
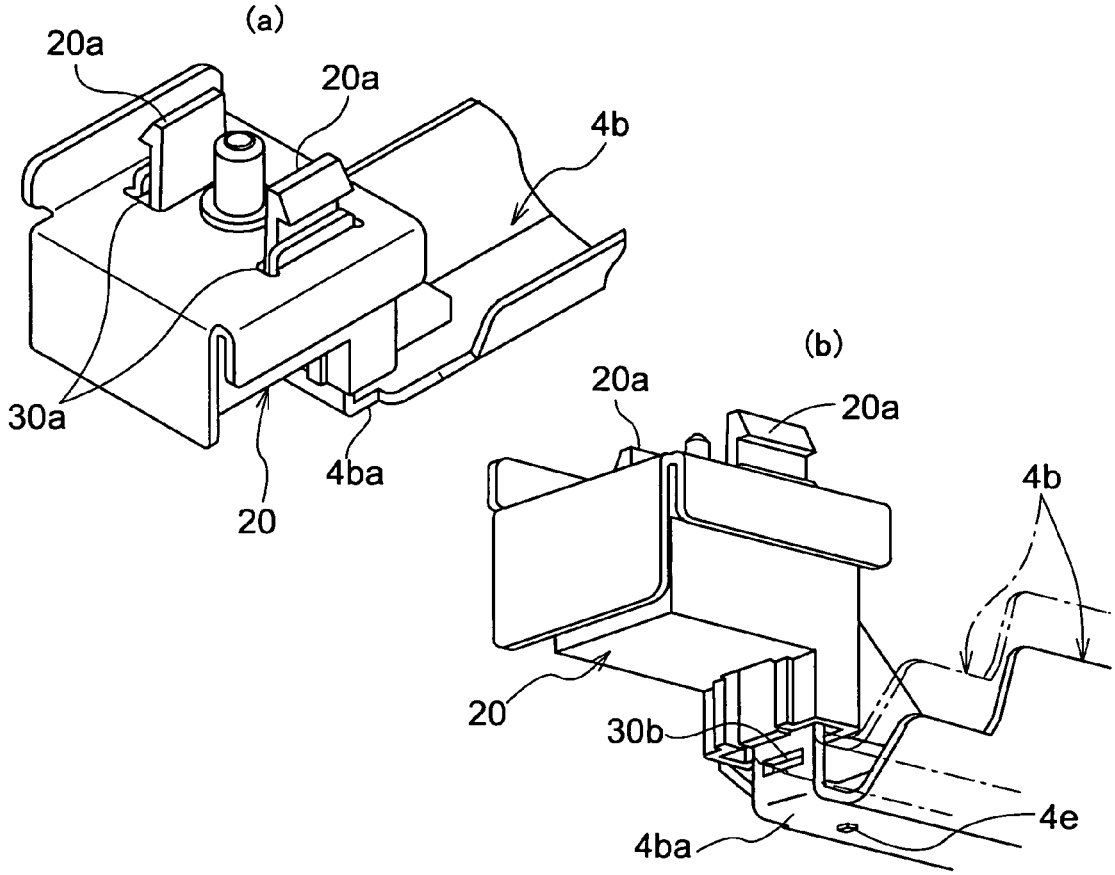
FIG. 10 is a perspective view of a joint member, as seen from above (a) and seen from bottom (b)
Figure 11:
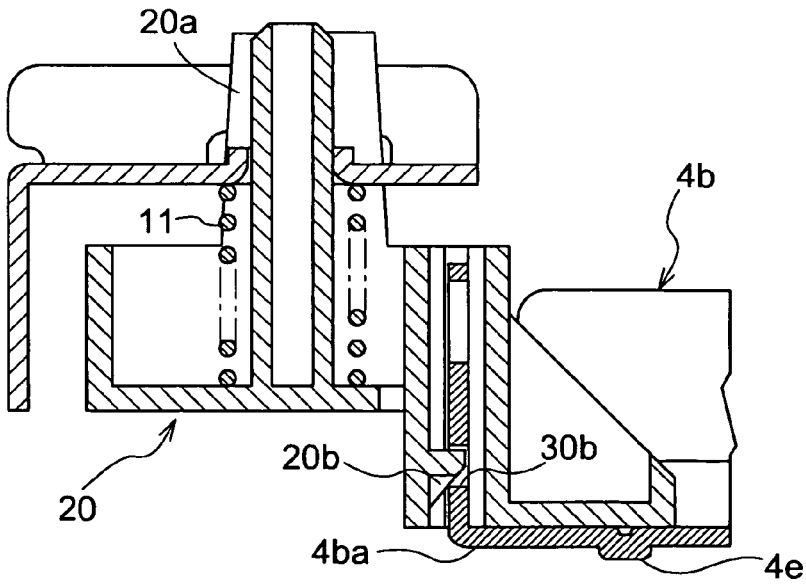
FIG. 11 is a section view of the joint member.

FIG. 10 is a perspective view of this joint member 20, as seen from above (a) and seen from bottom (b). And, FIG. 11 is a section view of the joint member 20.

As shown in FIG. 10, the joint member 20 includes a guide side engaging claw 20*b* as a guide side attaching portion detachably attachable to the reading guide 4*b* and cover engaging claws 20*a* (first engaging claws 9) as a cover side attaching portion detachably attachable to the cover means 4, so that via this joint member 20, the reading guide 4*b* is attached to the cover means 4.

Referring to the procedure of attachment of the reading guide 4*b* to the cover means 4, first, the joint member 20 is connected with the cover means 4 in advance. This connection is effected by engaging the cover side engaging claws 20*a* of the joint member 20 into the first retaining holes 30*a* provided in the cover means 4. In this, if appropriate, an elastic member such as a coil spring may be interposed between the cover means 4 and the joint member 20. Next, the reading guide 4*b* is attached to the guide side engaging claw 20*b* of the joint member 20. This attachment is effected by engaging the guide side engaging claw 20*b* of the joint member 20 into an attachment retaining hole 30*b* formed in the reading guide 4*b*. These operations can be done in a simple one-touch operation manner.

On the other hand, the operation of detaching the reading guide 4*b* from the cover means 4 can be carried out in the reverse manner to the above. Specifically, the guide side engaging claw 20*b* will be pulled out of the attachment retaining hole 30*b* with fingers, etc. and then reading guide 4*b* will be slid downward. With this, the reading guide 4*b* will be detached from the joint member 20. The operation for detaching the joint member 20 from the cover means 4 can be done similarly.

As described above, with this construction of attaching the reading guide 4*b* to the cover means 4 via the joint member 20, the attaching and detaching operations of the reading guide 4*b* do not require any special tool or skill of an experienced worker. Yet, the assembly and maintenance operations, etc. can be done easily and reliably.

Incidentally, as the joint member 20 is provided as a separate component which is attachable to and detachable from the cover means 4 and the reading guide 4*b*, in the event of attachment/detachment of the reading guide 4*b* to/from the cover means 4, this joint member 20 per se may be replaced by a different one. This will provide the possibility of optionally incorporating an elastic member such as a coil spring having an optimum elasticity in the joint member 20 or selectively the material for forming the joint member 20 per se in accordance with thickness, type of material etc. of the paper sheet to employed in the image forming apparatus.

Incidentally, the joint member 20 can be employed not only on the first end portion 4*ba* side, but also on the second end portion 4*bb* side at a time, or this joint member 20 can be employed only on the first end portion 4*ba* side or second end portion 4*bb* side, without using the joint member 20 for the other side.

[Releasig Mechanism]

In the first and second embodiments including the urging means described above, the cover means 4 can include a transport cover 40*a* of the automatic document feeding mechanism 5 which cover can be opened/closed. And, there can be provided a releasing mechanism 40 operable to release the urging force of the urging means in operative association with the opening/closing operation of this transport cover 40*a*. This releasing mechanism 40 is used for dissolving paper jam.

Figure 12:
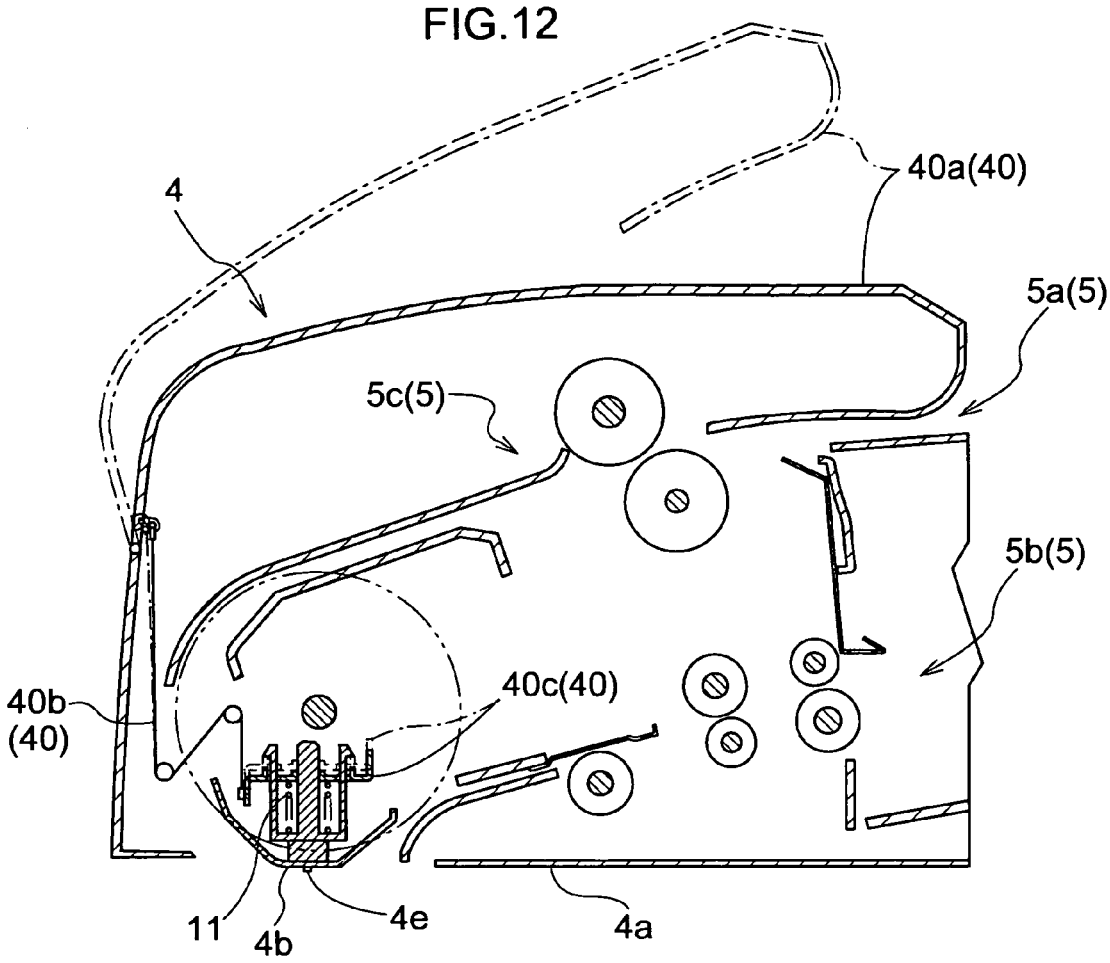
FIG. 12 is a conceptual diagram showing, in section, an automatic document feeding mechanism having a release mechanism.
Figure 13:
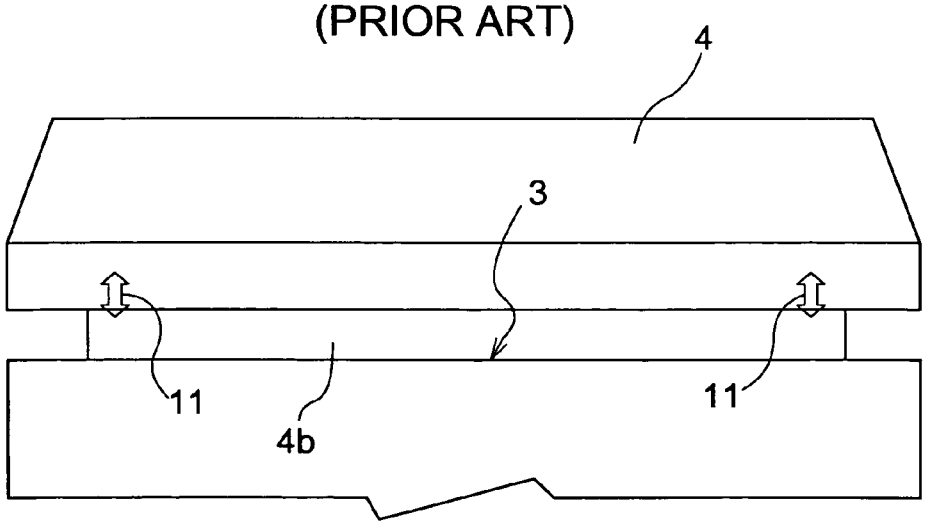
FIG.13 (PRIOR ART)
FIG. 13 is a explanatory view showing a conventional image forming apparatus from its left side, with a reading guide being urged under a closed condition of a cover means.

FIG. 12 is a conceptual diagram of the automatic document feeding mechanism 5 having such releasing mechanism 40. To the transport cover 40*a*, there is attached, via a coupling mechanism 40*b* comprising a wire and a pulley, a compressing member 40*c* for compressing the coil spring 11. The transport cover 40*a*, the coupling mechanism 40*b* and the compressing member 40*c* together constitute the releasing mechanism 40. Alternatively, the coupling mechanism 40*b* can be formed of links.

The coupling mechanism 40*b* is capable of operably coupling the transport cover 40*a* and the compressing member 40*c*, as described below.

Under the normal closed condition of the transport cover 40*a*, the compressing member 40*c* effectively compresses the coil spring 11. Now, if a paper jam occurs within the automatic document feeding mechanism 5 and then the worker opens up the transport cover 40*a*, this will pull up the wire of the coupling mechanism 40*b*, thus moving the compressing member 40*c* upward. In association with this, the compression applied to the coil spring 11 is released. And, under this condition, the urging force applied from the reading guide 4*b* to the automatic reading area 3B is released, so that the paper sheet jammed within the automatic document feeding mechanism 5 can be removed easily.

When the worker closes the transport cover 40*a* after completion of the paper jam clearing operation, the wire of the coupling mechanism 40*b* is returned, thus moving the compressing member 40*c* downward. In this, by optionally providing a return spring (not shown) in the compressing member 40*c*, the compressing member 40*c* can be positively moved downward. With the above, the coil spring 11 is again compressed by the compressing member 40*c*, and the reading guide 4*b* is again urged against the automatic reading area 3B.

OTHER EMBODIMENTS

Next, some other embodiments of the invention will be described.

<1> The urging means is not limited to the coil spring described in the foregoing embodiments. For instance, this urging means can employ a plate spring, elastic rubber, etc. Hence, any member or material capable of urging the reading guide 4*b* against the platen glass 3 side may be employed. And, all such members and/or materials are understood to be included in what is referred to as "urging means" herein.

<2> The shape and material of the reading guide 4*b* are not limited to those described in the foregoing embodiments. This reading guide 4*b* can have any other shape or can be formed of any other material.

<3> The image forming apparatus is not limited to those described in the foregoing embodiments comprising the apparatus body 2, the cover means 4, etc. The apparatus can have any other shape or can be formed of any other material.

Incidentally, although reference marks and numerals have been provided for the purpose of facilitating reference to the accompanying drawings, it is understood that the provision of such marks and/or numerals dos not limit the scope of the invention to the particular constructions described or shown. A skilled artisan could readily embody this invention in any other manner without deviating from the essential concept thereof defined in the appended claims.

The invention claimed is:

1. An image forming apparatus comprising:

a platen glass face provided in an apparatus body and having a reading area for reading a document set under a stationary condition thereof and an automatic reading area for reading the document while the document is guided past over this automatic reading area by an automatic document feeding mechanism;

a cover means mounting said automatic document feeding mechanism and attached to the apparatus body via a pivot shaft to be pivoted for selectively opening/closing the platen glass face;

a reading guide attached to said cover means and configured for guiding the document in opposition to said automatic reading area when said cover means is closed, said reading guide having a first end portion close to said pivot shaft attached to be movable to/away from said cover means and a second end portion away from said pivot shaft attached to be immovable to/away from said cover means; and an urging means for urging said first end portion of the reading guide toward said automatic reading area.

2. The image forming apparatus according to claim 1, wherein a transport cover of said automatic document feeding mechanism is attached to said cover means to be opened and closed, and there is provided a releasing mechanism operable to release the urging force of said urging means in operative association with opening/closing of said transport cover.

3. The image forming apparatus according to claim 1, wherein said reading guide is attached to said cover means via a joint member having a guide side attaching portion which is attachable to and detachable from the reading guide and a cover side attaching portion which is attachable to and detachable from the cover means.

4. An image forming apparatus comprising:

a platen glass face provided in an apparatus body and having a reading area for reading a document set under a stationary condition thereof and an automatic reading area for reading the document while the document is guided past over this automatic reading area by an automatic document feeding mechanism;

a cover means mounting said automatic document feeding mechanism and attached to the apparatus body via a pivot shaft to be pivoted for selectively opening/closing the platen glass face;

a reading guide attached to said cover means and configured for guiding the document in opposition to said automatic reading area when said cover means is closed, said reading guide having a first end portion close to said pivot shaft attached to be movable to/away from said cover means and a second end portion away from said pivot shaft attached to be movable to/away from said cover means; and a first urging means and a second urging means for urging said first end portion and said second end portion of the reading guide toward said automatic reading area, respectively, urging forces of said first urging means and said second urging means being set such that an urging resistive moment applied to said entire reading guide when the cover means is closed is smaller than a gravitational moment applied to said platen glass face from the center of gravity of said cover means and also that an urging resistive moment applied to said second end portion is smaller than said urging resistive moment applied to said first end portion.

5. The image forming apparatus according to claim 4, wherein a transport cover of said automatic document feeding mechanism is attached to said cover means to be opened and closed, and there is provided a releasing mechanism operable to release the urging forces of said first and second urging means in operative association with opening/closing of said transport cover.

6. The image forming apparatus according to claim 4, wherein said reading guide is attached to said cover means via a joint member having a guide side attaching portion which is attachable to and detachable from the reading guide and a cover side attaching portion which is attachable to and detachable from the cover means.

* * * * *